US006482271B2

(12) United States Patent
Sakai et al.

(10) Patent No.: US 6,482,271 B2
(45) Date of Patent: Nov. 19, 2002

(54) GRAIN-ORIENTED ELECTRICAL STEEL SHEET EXCELLENT IN MAGNETIC PROPERTIES

(75) Inventors: Tatsuhiko Sakai, Futtsu (JP); Naoya Hamada, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 7 days.

(21) Appl. No.: 09/841,019

(22) Filed: Apr. 24, 2001

(65) Prior Publication Data

US 2001/0032684 A1 Oct. 25, 2001

(30) Foreign Application Priority Data

Apr. 24, 2000 (JP) ..... 2000-123250

(51) Int. Cl.[7] ..... C12D 8/12; C22C 38/02
(52) U.S. Cl. ..... 148/111; 148/121
(58) Field of Search ..... 148/111, 112

(56) References Cited

U.S. PATENT DOCUMENTS

| | | | | |
|---|---|---|---|---|
| 4,645,547 A | | 2/1987 | Krause et al. | |
| 6,368,424 B1 | * | 4/2002 | Sakai et al. | 148/111 |
| 6,387,522 B2 | * | 5/2002 | Mogi et al. | 148/100 |

FOREIGN PATENT DOCUMENTS

| | | |
|---|---|---|
| JP | 55-18566 | 2/1980 |
| JP | 62-49322 | 10/1987 |
| JP | 5-32881 | 5/1993 |
| JP | 10-204533 | 8/1998 |

* cited by examiner

*Primary Examiner*—Deborah Yee
(74) *Attorney, Agent, or Firm*—Kenyon & Kenyon

(57) ABSTRACT

The present invention relates to a grain-oriented electrical steel sheet excellent in magnetic properties, which are improved by irradiating laser beams onto the positions paired on the both surfaces of the steel sheet and forming fine closure domains, characterized in that the width of the closure domains in the rolling direction is 0.3 mm or less and the deviation in the rolling direction between the positions of the paired closure domains on the both surfaces is equal to or smaller than the width of said closure domains in the rolling direction. Further, the present invention relates to a grain-oriented electrical steel sheet excellent in magnetic properties, characterized in that the steel sheet has the marks of laser irradiation on its surface. Yet further, the present invention relates to a grain-oriented electrical steel sheet excellent in magnetic properties, characterized in that the substrate steel is not exposed at the portions of laser irradiation on the surface of the steel sheet.

3 Claims, 7 Drawing Sheets

GRAIN-ORIENTED ELECTRICAL STEEL SHEET EXCELLENT IN MAGNETIC PROPERTIES

BACKGROUND OF THE INVENTION

1. Field of the Invention

The present invention relates to a grain-oriented electrical steel sheet having magnetic properties improved by irradiation with laser beams.

2. Description of the Related Art

In manufacturing processes of grain-oriented electrical steel sheets, various methods have so far been proposed to fractionate 180° magnetic domains and reduce core loss by inducing mechanical strains at the surface of a steel sheet and forming local closure domains after forming a glass film on the surface of the steel sheet and further applying an insulation coating. Among such methods, the method of irradiating the focused beams of a pulsed YAG laser on the surface of a steel sheet and inducing strains by the evaporation reaction of a film at the irradiated portions, as disclosed in Japanese Unexamined Patent Publication No. S55-18566, is a highly reliable, controllable and excellent method for manufacturing a grain-oriented electrical steel sheet since the method provides a great iron loss improvement effect and is a non-contact processing method.

In such a method, an insulation film on the surface of a steel sheet is destroyed, causing the marks of laser irradiation where the substrate steel is exposed. Therefore, additional coating for rust prevention and insulation is required after the laser irradiation. Then, as further advanced methods, various technologies have been designed to introduce strains while suppressing the damages of a film and are disclosed in U.S. Pat. No. 4,645,547, Japanese Examined Patent Application Nos. S62-49322 and H5-32881 and Japanese Unexamined Patent Publication No. H10-204533, etc.

Further, as a method of laser irradiation, an example of irradiating laser to the locations confronting each other on the both surfaces of a steel sheet is disclosed as one of the embodiments in U.S. Pat. No. 4,645,547. However, this method does not show particularly excellent iron loss improvement compared with a case of the irradiation on only one surface.

The principle of improving iron loss by laser irradiation can be explained as follows. The iron loss of a grain-oriented electrical steel sheet is divided into anomaly eddy current loss and hysteresis loss. When laser is irradiated onto a steel sheet, strains are generated on the surface layer by either evaporation reaction of a film or rapid heating/rapid cooling. Originating in these strains, closure domains are generated having nearly the same width as that of the strains and the 180° magnetic domains are fractionated so as to minimize magnetostatic energy there. As a result, eddy current loss decreases in proportion to the width of the 180° magnetic domains and iron loss decreases accordingly. On the other hand, if strains are introduced, hysteresis loss increases. That is, the reduction of iron loss by laser irradiation is, as shown in the schematic graph of FIG. 11, to impose the strains most suitable for minimizing iron loss which is the sum of the reduction of eddy current loss and the increase of hysteresis loss accompanying the increase of the amount of strains.

Therefore, from an ideal viewpoint, it is desirable to lower the eddy current loss sufficiently and, at the same time, to suppress the increase of hysteresis loss to the utmost. The realization of such a grain-oriented electrical steel sheet has been desired.

Further, magnetostriction, which is one of the important parameters of the magnetic properties of a grain-oriented electrical steel sheet, like iron loss, affects noise generation when an electrical steel sheet is used for an iron core of a transformer. When an external magnetic field is imposed, magnetostriction increases since closure domains expand and contract in the direction of the magnetic field. Therefore, though iron loss can be reduced by forming closure domains, there has been a problem that there is a possibility of increasing magnetostriction.

SUMMARY OF THE INVENTION

An object of the present invention is to provide a grain-oriented electrical steel sheet having magnetic properties improved by laser irradiation, the maximum iron loss improvement effect being obtained efficiently, and the increase in magnetostriction being suppressed. Further, another object of the present invention is to provide a grain-oriented electrical steel sheet with excellent magnetic properties wherein the substrate steel is not exposed at the irradiated portions after laser irradiation and an additional coating is not required.

The present invention relates to a grain-oriented electrical steel sheet excellent in magnetic properties, which are improved by irradiating laser beams onto the positions paired on the both surfaces of the steel sheet and forming fine closure domains, characterized in that the width of the closure domains in the rolling direction is 0.3 mm or less and the deviation in the rolling direction between the positions of the paired closure domains on the both surfaces is equal to or smaller than the width of said closure domains in the rolling direction. Further, the present invention relates to a grain-oriented electrical steel sheet excellent in magnetic properties, characterized in that the steel sheet has the marks of laser irradiation on its surface. Yet further, the present invention relates to a grain-oriented electrical steel sheet excellent in magnetic properties, characterized in that the substrate steel is not exposed at the portions of laser irradiation on the surface of the steel sheet.

DESCRIPTION OF THE PREFERRED EMBODIMENT

EXAMPLE 1

The embodiments and the effects of the present invention will be explained, hereunder, using examples. Firstly, with regard to a grain-oriented electrical steel sheet having iron loss improved by laser irradiation on its both surfaces, the range where a higher iron loss improvement rate can be obtained than in the case of the irradiation on one surface will be explained hereunder. Example 1 is a grain-oriented electrical steel sheet having iron loss improved by focusing a laser beam into a minute round shape, irradiating a pulsed laser beam having relatively high pulse energy density, evaporating and dispersing the films on the surfaces of the steel sheet, and imposing strains generated thereby.

Figure 8:
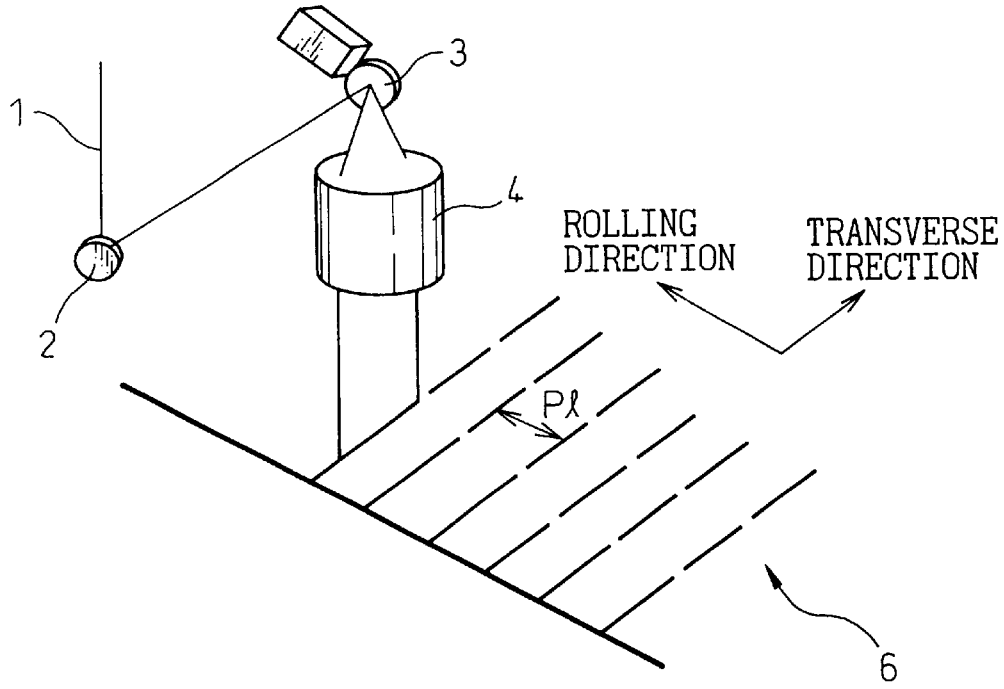
FIG. 8 is an example of a method for improving the iron loss of an electrical steel sheet by laser irradiation onto one surface.
Figure 9:
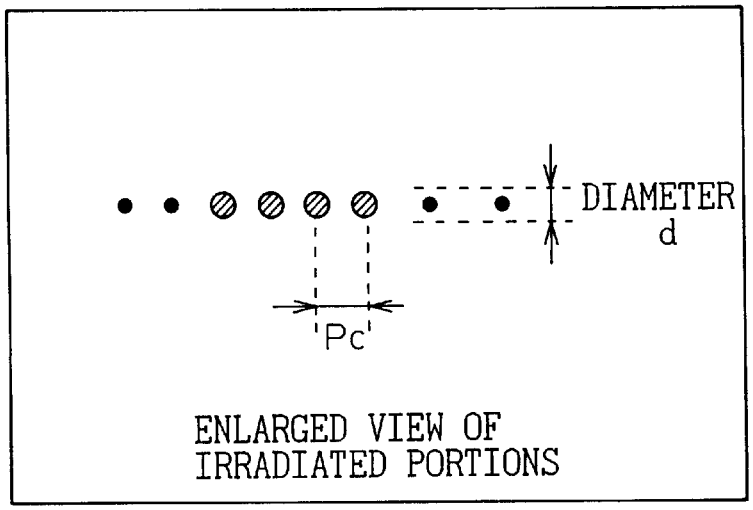
FIG. 9 is a schematic diagram of irradiation marks formed in an irradiation method of improving iron loss by film evaporation reaction generated by laser irradiation.

FIG. 8 is an explanatory view of an apparatus for producing a grain-oriented electrical steel sheet by irradiating laser on one surface only. A laser beam 1 is emitted by a Q-switched pulsed $CO_2$ laser, not shown in the drawing, and focused and irradiated, while scanning, with an fθ lens 4 via a total reflection mirror 2 and a scanning mirror 3. The scanning is performed in the direction substantially perpendicular to the rolling direction of the steel sheet. The shape of the focused laser beam is substantially round and the focused diameter d is varied within the range of 0.2 to 0.6 mm by adjusting the focus of the lens. The pitch of the linear irradiation in the rolling direction Pl is 6.5 mm. The repetition frequency of the laser pulse is 90 kHz and the pitch of the irradiation in the transverse direction Pc is selected so as to be almost the same as the irradiated beam diameter by adjusting the scanning speed. Therefore, the laser irradiation marks are in a row virtually contacting each other in the transverse direction. FIG. 9 is a schematic diagram of laser irradiation marks. The pulse energy Ep is adjusted to 4 to 10 mJ and the irradiation energy density Ed is controlled conforming to the control of the focused beam diameter d. Here, the irradiation energy density Ed is, with the focused beam area referred to as S, defined by the following equation:

$$Ed=Ep/S(\mathrm{mJ/mm^2}).$$

Figure 7:
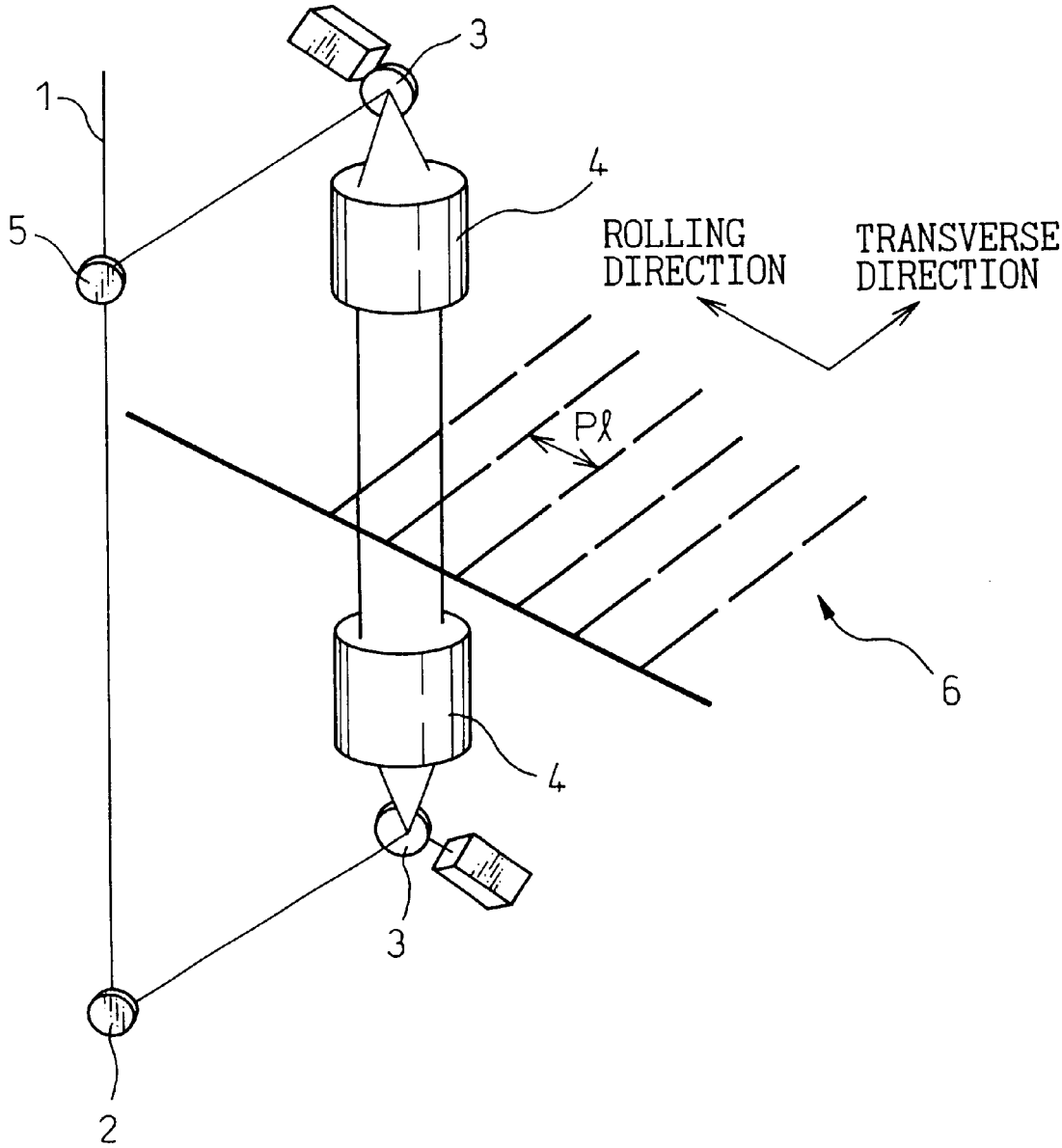
FIG. 7 is an example of a process for producing a grain-oriented electrical steel sheet according to the present invention.

FIG. 7 is an explanatory view of an apparatus for producing a grain-oriented electrical steel sheet by irradiating laser on its both surfaces according to the present invention. A laser beam 1 is emitted by a Q-switched pulsed $CO_2$ laser, not shown in the drawing, split into two beams by a beam splitter 5, and irradiated on the positions nearly opposite each other of the top and bottom surfaces by beam-focusing unit disposed independently. Each laser pulse energy irradiated on each surface is controlled within the range of 2 to 5 mJ. The other irradiation conditions are the same as those explained in relation to FIG. 8. The irradiated positions of the top and bottom surfaces in the rolling direction are adjusted by the fine tuning of a transfer table, not shown in the drawing.

Using those apparatuses, a laser beam is irradiated on a grain-oriented electrical steel sheets with the thickness of 0.23 mm and the relationship between the width in the rolling direction of closure domains Wcd originated from stress strains generated at the laser irradiated portions and the iron loss improvement rate at the magnetic field of 1.7 T and 50 Hz is investigated. The iron loss improvement rate η is defined by the following equation:

$$\eta=[(\text{iron loss before laser irradiation}-\text{iron loss after laser irradiation})/\text{iron loss before laser irradiation}]\times 100\ (\%).$$

Here, the width of closure domains is observed by an electron microscope for magnetic domain observation.

Figure 2:
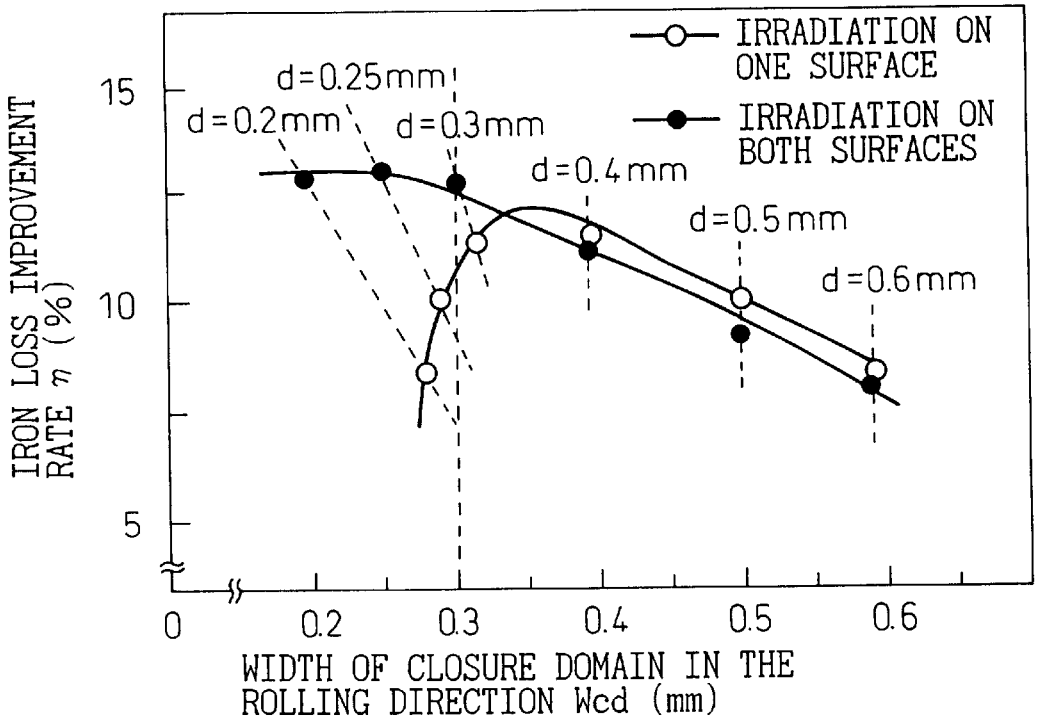
FIG. 2 is an explanatory view showing the relationship between the width of closure domains and the core loss improvement rate in both the case that laser is irradiated on both surfaces according to the present invention and the case of irradiation onto only one surface, with regard to grain-oriented electrical steel sheets having core loss improved by film evaporation reaction generated by laser irradiation.

FIG. 2 shows the relationship between Wcd and iron loss improvement rate in the cases of laser irradiation on one surface and on both surfaces. In the case of laser irradiation on one surface, the pulse energy is fixed to 8 mJ and the focused beam diameter is varied to 0.2 to 0.6 mm. In the case of laser irradiation on both surfaces, the irradiation energy on each surface is fixed to 4 mJ respectively and the focused beam diameter is varied to 0.2 to 0.6 mm likewise. The relationship between Wcd and the irradiated beam diameter d is also shown in the figure. The deviations in the rolling direction between the closure domains paired on both surfaces are all 0 mm. A Wcd nearly proportional to a beam diameter can be obtained in the case of both surface irradiation. However, Wcd does not decrease to 0.27 mm or less even though the focused diameter is reduced in the case of one surface irradiation. This is because the range of strains generated by plasma acting as the secondary heat source increases and the strains wider and larger than the beam diameter are generated since the plasma generated during the evaporation of a film has a high temperature and becomes spatially large when the energy density Ed increases. As a result, hysteresis loss becomes excessive and iron loss improvement rate deteriorates.

In the region where the width of closure domains Wcd is 0.3 mm or larger, when the iron loss improvement rates of one surface irradiation and both surface irradiation are compared with each other, somewhat higher improvement rate is seen in the case of one surface irradiation. In the case of one surface irradiation, the energy density decreases in proportion to the increase of the irradiated beam diameter. As a result, the excessive plasma effect disappears, the increase of hysteresis loss is suppressed, and high iron loss improvement can be obtained. On the other hand, in the case of both surface irradiation, it is presumed that, though the strains at each surface are small, relatively large strains are introduced by accumulating the strains of both surfaces, the influence of the increase of hysteresis loss is relatively large compared with the case of one surface irradiation, and thus the iron loss improvement rate deteriorates.

On the other hand, in the region that the width of closure domains wcd is 0.3 mm or less, the width of strains is small and the increased amount of hysteresis loss is also small. In addition, the depth of the closure domains originated from one surface is shallow and the effect of eddy current loss reduction also deteriorates. However, since the closure domains from both surfaces supplement the permeation depth in the thickness direction, the closure domains sufficiently penetrating in the thickness direction are formed as a result. That is, the closure domains which are narrow in the rolling direction and deep in the thickness direction are formed and, as a result, the eddy current loss is sufficiently reduced and, at the same time, the increase of hysteresis loss is markedly suppressed.

Figure 3:
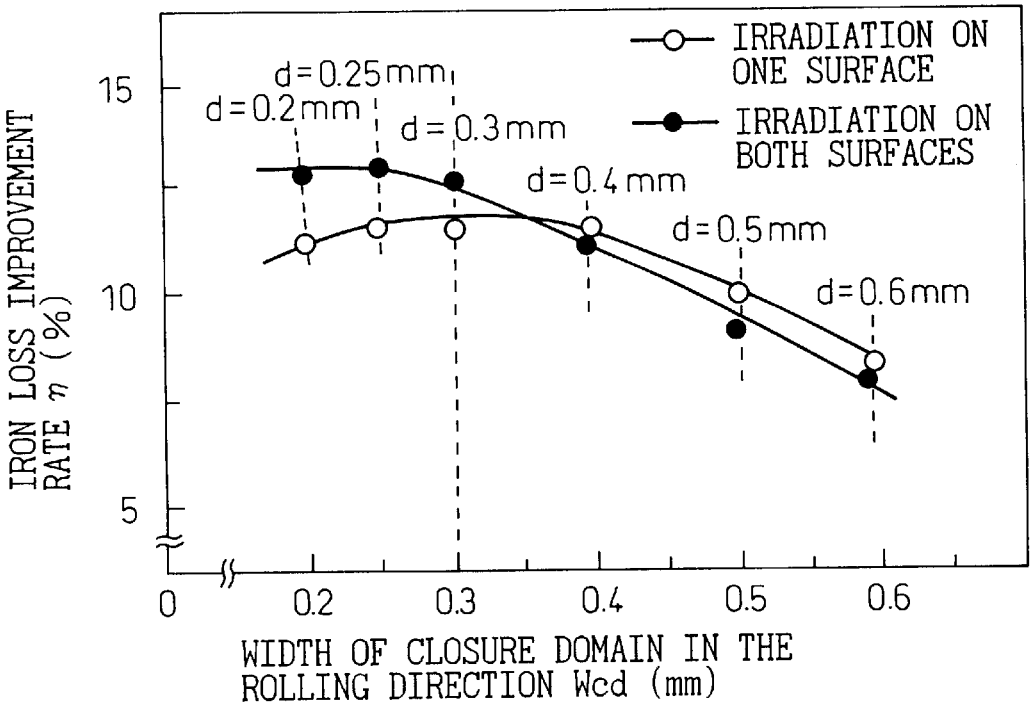
FIG. 3 is an explanatory view showing the relationship between the width of closure domains and the core loss improvement rate in both the case that laser is irradiated on both surfaces according to the present invention and the case of irradiation onto only one surface and the energy density is controlled so that the focused beam diameter is almost equal to the width of closure domains, with regard to a grain-oriented electrical steel sheets having iron loss improved by film evaporation reaction generated by laser irradiation.

It has been attempted to form closure domains having the width of 0.3 mm or less under the irradiation on one surface. In order to form closure domains with narrow width, there is no way other than to decrease energy density Ed for suppressing excessive plasma acting as the secondary heat source. Therefore, the pulse energy is reduced in proportion to the reduction of the condensed beam diameter and the energy density Ed is adjusted to the same level as the case of both surface irradiation. The relationship between Wcd and iron loss improvement rate in this case is compared with that in the case of both surface irradiation. The results are shown in FIG. 3. The relationship between Wcd and the irradiated beam diameter d is also shown in the figure. Even in the case of the beam diameter of 0.3 mm or less under the one surface irradiation, closure domains with widths almost equal to the beam diameter are obtained. The data in the case of the both surface irradiation shown here are identical to those shown in FIG. 2.

When Wcd is 0.3 mm or less, the both surface irradiation shows a higher iron loss improvement rate than expected. In this comparison, since the energy density is identical, stress strains and closure domains per one surface are identical too. In the case of both surface irradiation, since the closure domains from both surfaces supplement the permeation depth in the thickness direction, the effect of eddy current loss reduction is high. On the other hand, in the case of one surface irradiation, the effect does not appear and the iron loss improvement rate is also low accordingly. When Wcd is in the range of 0.3 mm or larger, as explained above, the influence of the increase of hysteresis loss is relatively large in the case of introducing strains on both surfaces, while the one surface irradiation shows somewhat higher iron loss improvement rate than that in the case of the both surface irradiation.

Figure 1:
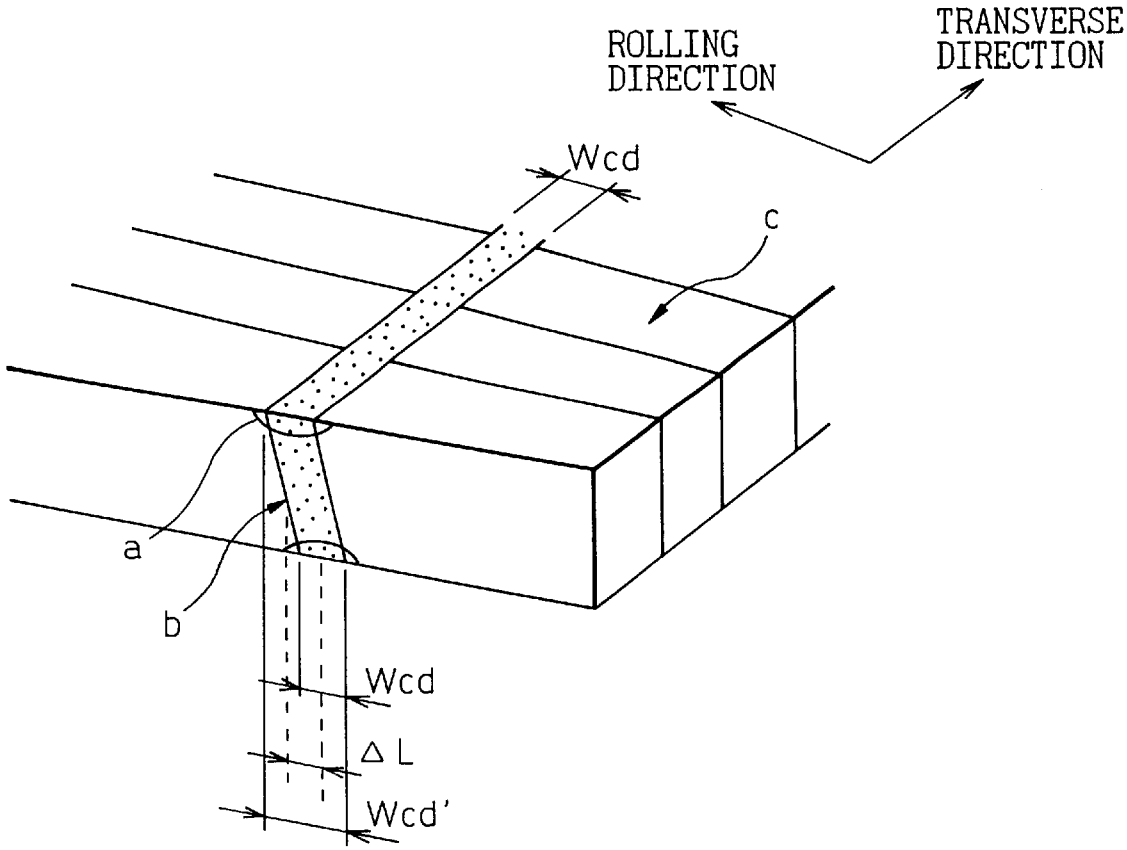
FIG. 1 is an explanatory sectional view showing the deviation between the positions where closure domains are formed in a grain-oriented electrical steel sheet according to the present invention.
Figure 4:
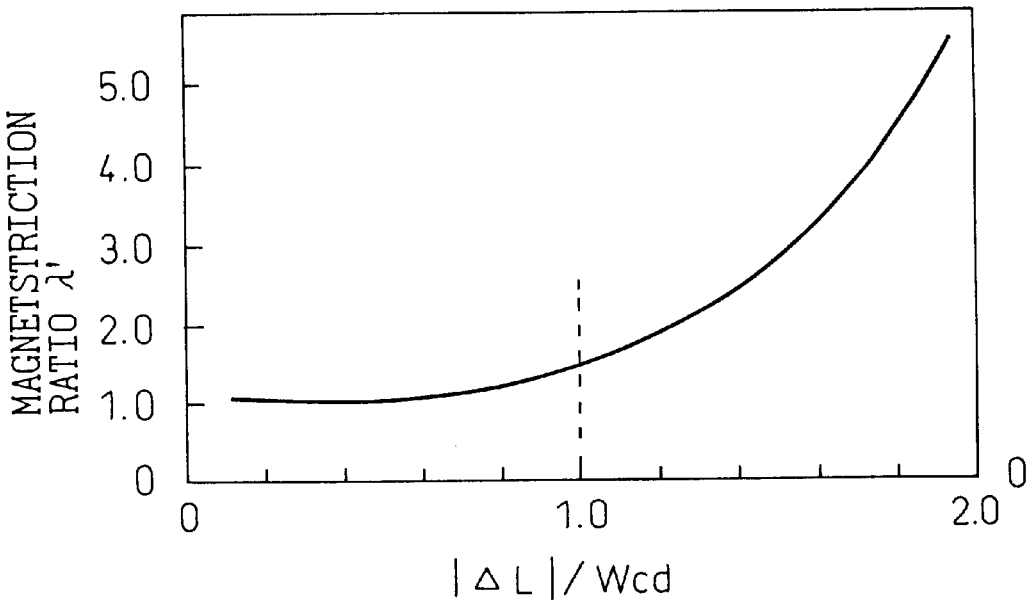
FIG. 4 is a graph showing the relationship between the deviation of the positions of closure domains at the top and bottom surfaces and the magnetostriction ratio of an electrical steel sheet according to the present invention.

Next, the optimum range of the deviation in the rolling direction between the locations of closure domains paired at the top and bottom surfaces will be explained hereunder. FIG. 1 is a schematic diagram of a grain-oriented electrical steel sheet according to the present invention and for explaining the location deviation of closure domains. Here, the width of a closure domain b with a strain a at each surface as a cardinal point is referred to as Wcd, the absolute value of the deviation between the centers of closure domains at each surface $|\Delta L|$, and the equivalent width of a closure domain in the rolling direction Wcd'. FIG. 4 shows the relationship between $|\Delta L|$/Wcd and magnetostriction ratio $\lambda'$ when laser is irradiated on both surfaces, the laser beam diameter is focused to 0.3 mm, Wcd is 0.3 mm, and the amount of the location deviation $|\Delta L|$ is varied within the range of 0 to 0.6 mm. Here, magnetostriction ratio $\eta'$ is the ratio of magnetostriction ratio $\eta$ when $|\Delta L|>0$ to magnetostriction ratio $\eta 0$ when $|\Delta L|=0$. The magnetostriction increases as $|\Delta L|$ increases and the increase of the magnetostriction is remarkable in the range where $|\Delta L|/Wcd>1$. This is attributed to the increase of the equivalent width of a closure domain Wcd' causing the increase of the magnetostriction.

Figure 5:
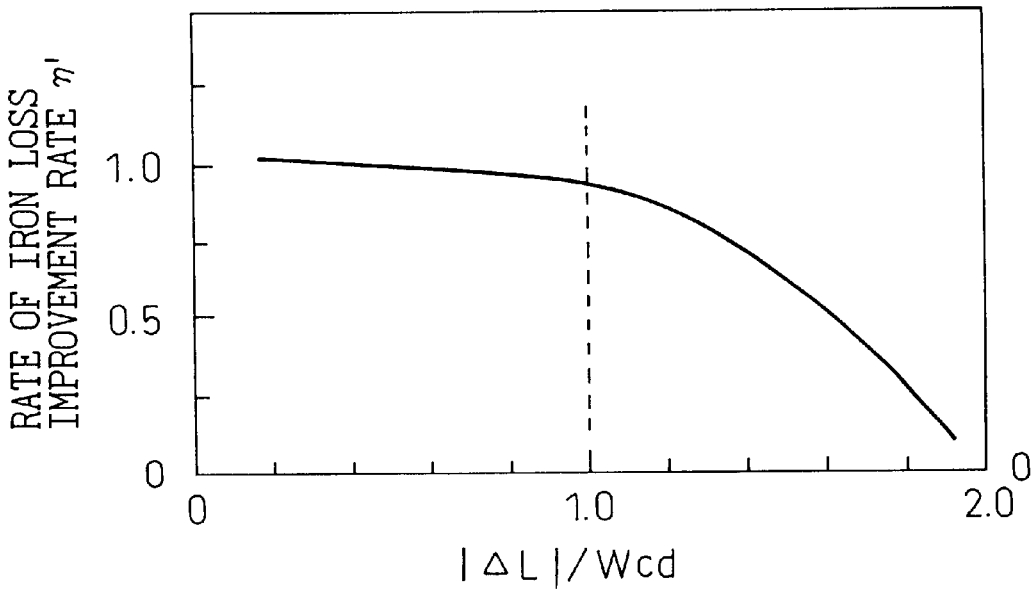
FIG. 5 is a graph showing the relationship between the deviation of the positions of closure domains at the top and bottom surfaces and the ratio of the core loss improvement rate of an electrical steel sheet according to the present invention.

FIG. 5 shows the relationship between $|\Delta L|$/Wcd and the ratio of iron loss improvement rate $\eta'$. Here, $\eta'$ is the ratio of the iron loss improvement rate $\eta 0$ when $|\Delta L|=0$ to the iron loss improvement rate $\eta$ when $|\Delta L|>0$. From the graph, the core loss improvement rate decreases remarkably in the range of $|\Delta L|/Wcd>1$. This is because the effect of supplementing the permeating depth of the closure domains from both surfaces disappears and, as a result, the iron loss improvement effect decreases.

Thus, a grain-oriented electrical steel sheet according to the present invention can have excellent properties in terms of both magnetostriction and iron loss by controlling $|\Delta L|$, which is the deviation of formed closure domains in the rolling direction, equal to or below Wcd, which is the width of the closure domains.

EXAMPLE 2

Next, examples of an irradiation method for not generating laser irradiation marks on the surface of a steel sheet will be explained hereunder. In an irradiation method for not generating laser irradiation marks on the surface of a steel sheet, stress strains are imposed by rapid heating/rapid cooling below the temperature where a vitreous film and an insulation coating on the surface evaporate and disperse. Therefore, the focused area of a laser beam is larger than that of Example 1 and it is necessary to reduce the energy density to one twentieth to one thirtieth of Example 1.

Figure 10:
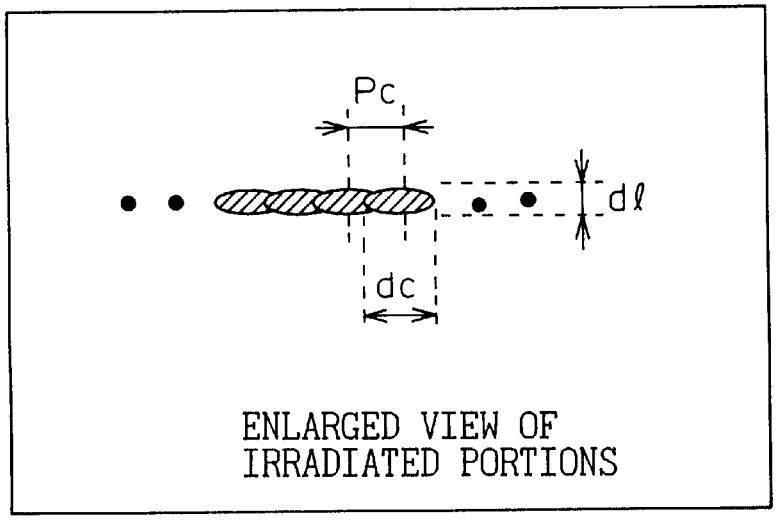
FIG. 10 is a schematic diagram of the shape of irradiated beams in the case of improving core loss by the rapid heating/rapid cooling caused by laser irradiation on the surface of a steel sheet.
Figure 11:
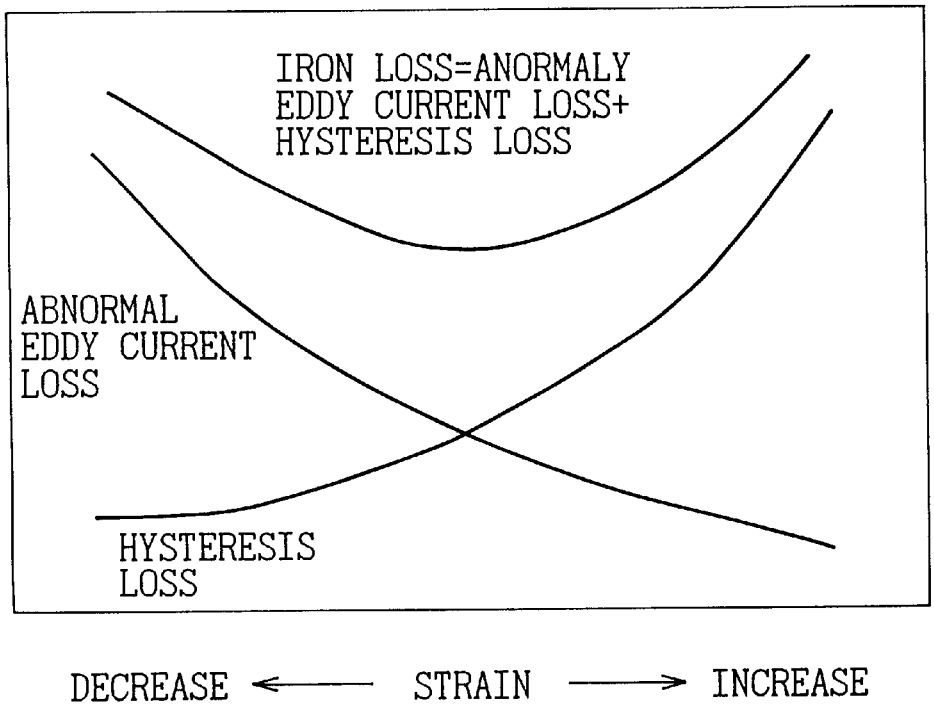
FIG. 11 is a schematic diagram showing a relationships stress, strain, eddy current loss and hysteresis loss.

FIG. 10 is an explanatory view of the shape of an irradiated beam in an irradiation method for not generating laser irradiation marks on the surface of a steel sheet. A laser beam is focused and forms an elliptic shape having the major axis in the transverse direction. Here, the width of a focused laser beam in the rolling direction is referred to as dl and the width thereof in the transverse direction dc. The apparatus for irradiating a laser beam is the same as shown in FIGS. 7 and 8. A cylindrical lens, not shown in the drawing, is inserted in the way of beam propagation and the elliptic shape of the focused beam is controlled by adjusting the focus of an f$\theta$ lens 4 and changing the focal length of the cylindrical lens. The repetition frequency of the laser pulse is 90 kHz and the irradiation pitch Pc in the transverse direction is varied by adjusting the scanning speed.

In these examples, the shape of the focused laser beam is a combination of dl=0.2 to 0.6 mm and dc=4.0 to 10.0 mm and the pitch in the rolling direction of the locations where irradiation is imposed Pl is 6.5 mm. The irradiation pitch in the transverse direction is 0.5 mm.

Figure 6:
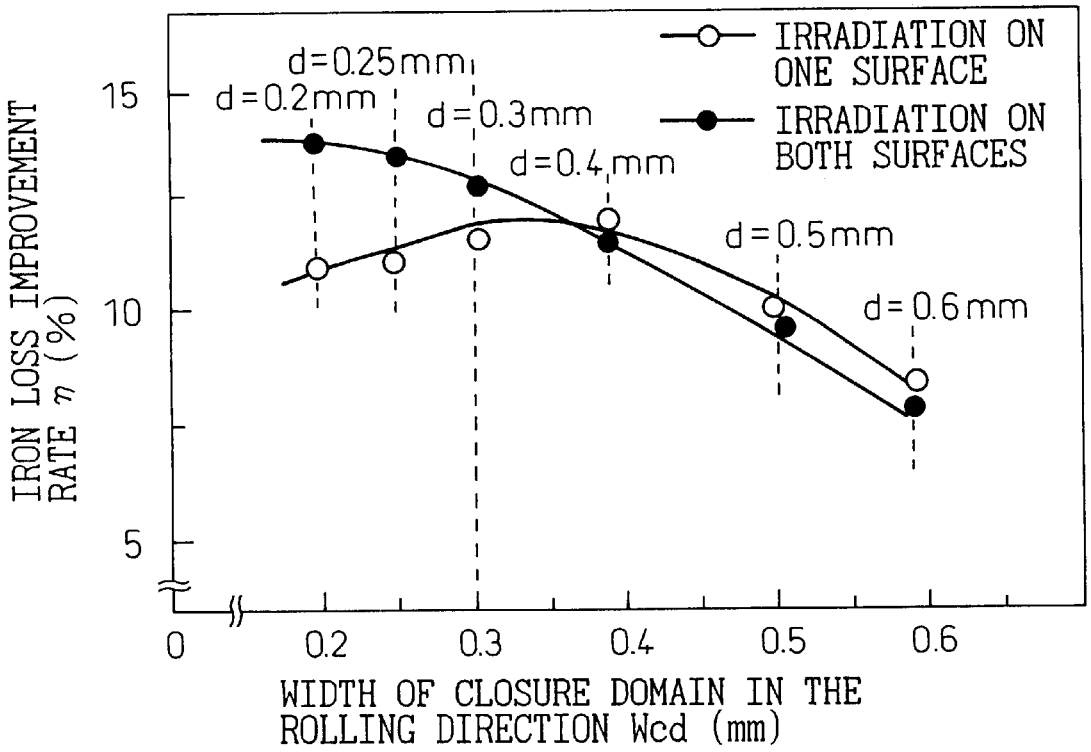
FIG. 6 is an explanatory view showing the relationship between the width of closure domains and the iron loss improvement rate in both the case that laser is irradiated on both surfaces according to the present invention and the case of irradiation onto only one surface, with regard to a grain-oriented electrical steel sheets having iron loss improved by the rapid heating/rapid cooling caused by laser irradiation on the surface of the steel sheet and having no laser irradiation marks.

FIG. 6 shows, in an irradiation method for not generating laser irradiation marks on the surface of a steel sheet, the relationship between Wcd and iron loss improvement rate in the cases that laser beam is irradiated onto only one surface and onto both surfaces. In the case of the irradiation on only one surface, pulse energy is fixed at 8 mJ, condensed beam diameter in the rolling direction dl is varied within the range of 0.2 to 0.6 mm, and the beam diameter in the transverse direction dc is selected to be the minimum value within the range where surface irradiation marks are not generated at each dl. In the case of the irradiation on both surfaces, irradiation energy on each surface is fixed to 4 mJ respectively, focused beam diameter in the rolling direction is varied within the range of 0.2 to 0.6 mm likewise, and dc is also selected to be the minimum value within the range where surface irradiation marks are not generated. The deviations in the rolling direction of the closure domains paired on both surfaces are all 0 mm. Here, the relationship between Wcd and irradiated beam diameter in the rolling direction dl is also shown in the figure.

In case of one surface irradiation and the case of both surface irradiation, the width of closure domains Wcd observed is nearly equal to the focused beam diameter dl. It is presumed that the reason is, since the energy density is low to the extent that a surface film does not evaporate, the generation of plasma which acts as the secondary heat source is scarce and therefore the width of strains is also nearly equal to the beam diameter.

From these results, in an irradiation method for not generating laser irradiation marks on the surface of a steel sheet too, the steel sheet having closure domains with Wcd of 0.3 mm or less formed on the both surfaces shows a higher iron loss improvement rate than in the case of forming closure domains on only one surface, in the same way as shown in FIG. 3. Further, the extent of improvement is remarkable compared with the case of evaporating a film. This is because the effect of generating closure domains from both surfaces appears markedly since the strains caused by rapid heating/rapid cooling are somewhat weak compared with the strains caused by evaporation reaction.

Next, a method for distinguishing a grain-oriented electrical steel sheet having closure domains of 0.3 mm or less in width formed by imposing strains from the both surfaces according to the present invention from a conventional grain-oriented electrical steel sheet subjected to the irradiation on only one surface will be explained hereunder. The width of a closure domain can be determined by an electron microscope for magnetic domain observation. The judgement whether or not strains are introduced from both surfaces can be carried out based on the following means.

Since closure domains are generated with the strains in the surface layer portion of each surface as cardinal points, by removing the most surface layer portion containing the strains by etching, the closure domains with those as cardinal points disappear too. In a steel sheet having strains imposed from the both surfaces according to the present invention, even though the surface layer of one surface is removed, the closure domains generated from the other surface remain. On the other hand, in the case of imposing strains from only one surface, closure domains disappear completely by removing the surface layer of either surface. Therefore, whether or not closure domains are formed from both surfaces can be determined even when surface irradiation marks are not observed.

Further, in the examples of the present invention, closure domains are formed by the irradiation of a Q-switched pulsed $CO_2$ laser. However, a continuous wave laser or another laser than a $CO_2$ laser may be used as long as the closure domains, within the range specified in the present invention, are formed.

What is claimed is:

1. A grain-oriented electrical steel sheet excellent in magnetic properties, which are improved by irradiating laser beams to the positions paired on the both surfaces of the steel sheet and forming fine closure domains, characterized in that the width of the closure domains in the rolling direction is 0.3 mm or less and the deviation in the rolling direction between the positions of the paired closure domains on the both surfaces is equal to or smaller than the width of said closure domains in the rolling direction.

2. A grain-oriented electrical steel sheet excellent in magnetic properties according to claim 1, characterized in that the steel sheet has the marks of laser irradiation on its surfaces.

3. A grain-oriented electrical steel sheet excellent in magnetic properties according to claim 1, characterized in that the substrate steel is not exposed at the portions of laser irradiation on the surface of the steel sheet.

* * * * *